United States Patent [19]

Maxson et al.

[11] 4,281,592

[45] Aug. 4, 1981

[54] DOUBLE INDUCTION UNIT

[75] Inventors: Dale E. Maxson, Rockford, Ill.; David Ober, Warren, N.J.

[73] Assignee: Barber-Colman Company

[21] Appl. No.: 64,215

[22] Filed: Aug. 6, 1979

[51] Int. Cl.[3] ..... F24F 7/00

[52] U.S. Cl. ..... 98/38 R; 236/13; 236/49; 239/419.3; 137/889

[58] Field of Search ..... 98/38 R, 33 R; 236/13, 236/49; 181/272, 262; 239/419.3, 419.5, 427.3, 427.5; 137/888, 889, 892, 893, 895

[56] References Cited

U.S. PATENT DOCUMENTS 3,018,088 1/1962 Allander et al. ..... 98/38 R X 3,114,505 12/1963 Kennedy ..... 236/13

3,248,055 4/1966 Lord ..... 236/13

FOREIGN PATENT DOCUMENTS 2410845 10/1974 Fed. Rep. of Germany ..... 98/38 R

*Primary Examiner*—Edward G. Favors

*Assistant Examiner*—Henry Bennett

*Attorney, Agent, or Firm*—Robert M. Hammes, Jr.

[57] ABSTRACT

An air induction unit having a first induction means to induce secondary air through a first induction opening into a stream of primary air to produce an air stream of mixed primary and secondary air, and a second induction means to induce additional secondary air into the mixed air stream through a second induction opening.

4 Claims, 3 Drawing Figures

DOUBLE INDUCTION UNIT

BACKGROUND OF THE INVENTION

This invention relates to the field of air distribution of the type common to air conditioning systems in buildings. The invention particularly relates to air induction units used in such systems to induce secondary air into a stream of primary air supplied from a source for delivery to a zone of a building.

Air induction units are well known and typically comprise a box having a primary air inlet normally connected to a source of primary air and an outlet for delivering air to a point of use, such as a room or zone of a building. The induction unit is also typically provided with a secondary air inlet which permits secondary air to be induced or drawn into the unit for mixture with the primary air stream. The induction unit thus produces a stream of mixed primary and secondary air which is delivered to a conditioned zone. Control apparatus is also generally provided so that the amount of primary air can be regulated in response to a sensed condition such as temperature. It is also common to control the amount of secondary air induced in response to a sensed condition. This may be done by providing a damper associated with the secondary air inlet, appropriate control means being provided to operate the damper.

Particular situations are encountered in which it is desirable to provide induction units having high level induction capabilities in order to maximize the amount of secondary air which is induced so as to meet system air flow specifications. For example, energy conservation is a critical factor in the design of building air conditioning systems. One way to reduce system energy requirements is to design the system to operate at lower system primary air pressures than that often employed in older systems. In order to meet specified levels of air flow volume into building zones at these lower primary air pressures, induction of secondary air into the primary air stream must be increased.

Another typical situation in which such high level induction units would be desired is the case of an interior zone of a building in a heating mode in which the amount of additional heat required by the zone to adequately control temperature is relatively small. In such cases only a relatively low volume of primary air flow into the zone may be required with the result that this low volume air flow does not provide adequate air circulation within the zone. A solution to the air circulation problem is to provide an induction unit which permits an increase in the volume of air flowing into the zone by inducing secondary air into the primary air stream. By maximizing the induction of secondary air into the primary air stream air circulation within the zone can be improved. A further factor which may become important is that, generally, a single duct system and primary air supply serve both interior and exterior zones of a building. If a sufficiently high level of secondary air induction is not obtained in the interior zones, the specified volume of air discharged into the zone must be obtained by a higher level of primary air flow. Since the heating requirement of the interior zone is relatively low, a lower temperature supply system would be required. It may then be necessary to provide air distribution units with reheat capabilities in the exterior zones. This increases the cost of installation and operation of reheat units.

Several problems become evident when attempts are made to provide adequate air circulation within a zone having a low primary air volume requirement. A major factor is that space limitations associated with typical building air conditioning systems place size constraints on induction units which may be installed to deliver air to building zones. These induction unit size limitations necessarily limit the relative sizes of primary, secondary, and mixed air flow passages within the induction unit. It is apparent from momentum equations that there is a theoretical limit, determined by the geometry of air flow passages, on the amount of secondary air which can be induced at a single point of induction. Consequently, known induction units which induce air into the primary air stream at a single point have an inherent limit on their induction capabilities. Thus, the use of existing air induction units within system space limitations does not provide the air volume induction level required for satisfactory air circulation within the zone in many cases.

From the foregoing it is apparent that in situations in which it is desirable to obtain maximum induction of secondary air for a given primary air supply pressure, or alternatively, to deliver a specified volume of mixed primary and secondary air to the zone at a reduced primary air supply pressure there is a need for induction units having induction capabilities beyond that presently available in existing induction units.

SUMMARY OF THE INVENTION

The present invention solves the foregoing problems by providing an air induction unit having a first induction means for inducing secondary air into the flow of primary air to form a mixed air stream and a second induction means to induce additional secondary air for entrainment with the mixed air stream downstream from the first induction means.

In the preferred embodiment a stream of primary air is delivered into the unit and a first induction means induces a flow of secondary air into the unit through a secondary air inlet for entrainment with the primary air stream so as to form a stream of mixed primary and secondary air. The unit is further provided with a second induction means for inducing additional secondary air into the unit through a secondary air inlet for entrainment with the mixed air stream.

By providing an additional secondary air inlet the induction capabilities of the unit are improved so that the volume of induced air is increased beyond that which would be obtainable by prior art air induction units.

Other advantages and features of the invention will become apparent from the following detailed description taken in conjunction with the drawing figures.

DETAILED DESCRIPTION OF THE PREFERRED EMBODIMENT

Figure 1:
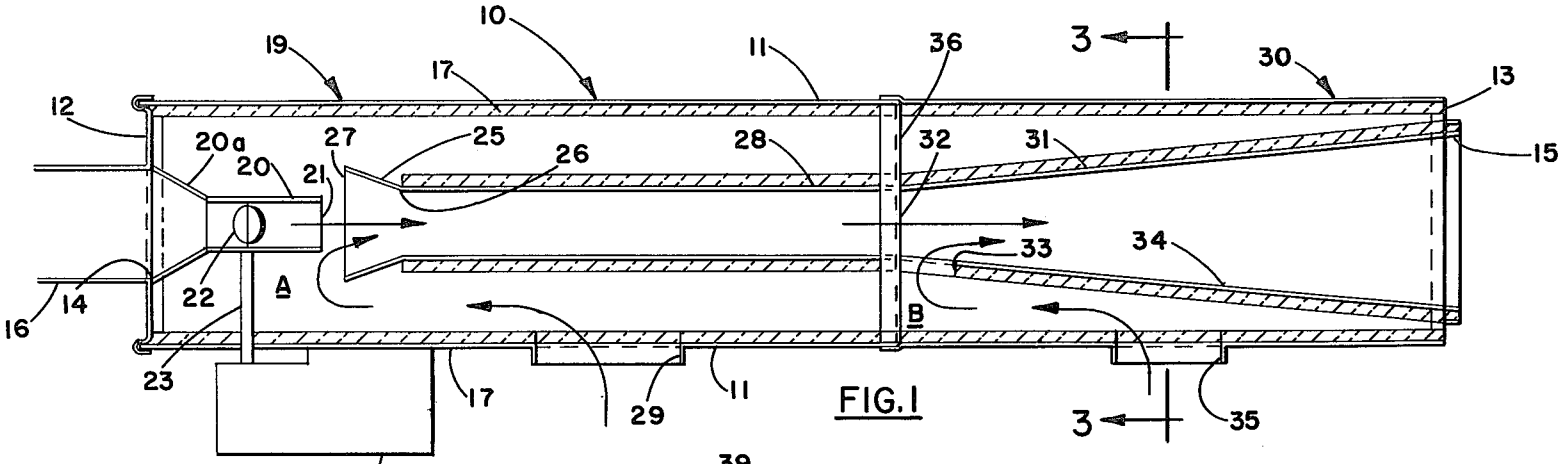
FIG. 1 is a top cross-sectional view of an air induction unit according to the invention.
Figure 2:
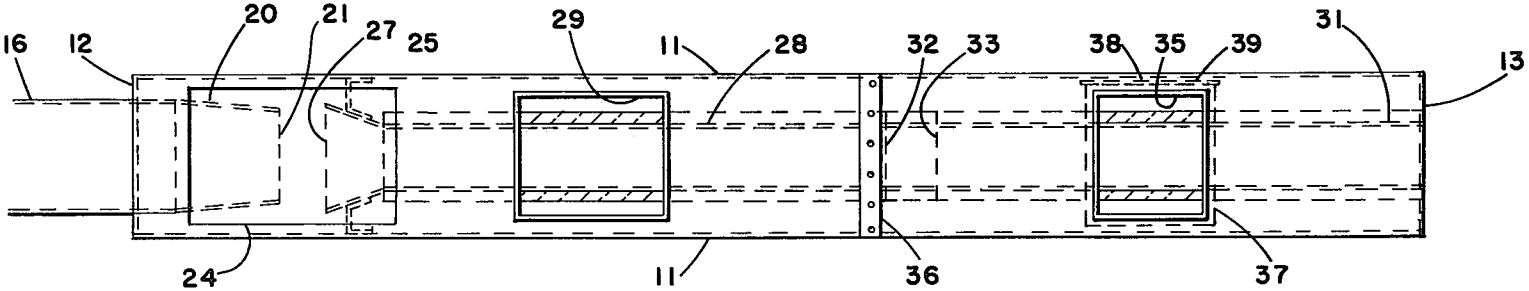
FIG. 2 is a front view of the air induction unit of FIG. 1, additionally showing a backflow damper associated with one of the secondary air inlets.

Referring now to FIGS. 1 and 2, an air induction unit, generally indicated at 10, is provided with side walls 11, an end wall 12, and an end wall 13 which form an enclosure or box. End wall 12 is provided with a primary air inlet 14 through which primary air may be delivered into induction unit 10. End wall 13 is provided with an outlet 15 through which air may be delivered to a point of use, such as a zone within a building. Primary air inlet 14 is connected to a source of primary air by primary air duct 16. The walls of unit 10 are preferably lined with sound deadening material, such as insulation 17 (not shown in FIG. 2 for purposes of clarity). A short duct 20 of lesser cross-sectional area than duct 16 is located within unit 10 and is connected to inlet 14 by tapered connecting portion 20*a*. Thus, as primary air flows into duct 20 from duct 16, the air velocity increases and a relatively high velocity air stream is delivered from nozzle opening 21 of duct 20 as indicated.

Air induction unit 10 is preferably further provided with means to control the flow of primary air through duct 20, such as damper 22. A control 24, which may be responsive to a sensed condition such as temperature, is connected to damper 22 by shaft 23 to selectively vary the position of damper 22 between open and closed positions. This construction permits variation of the amount of primary air delivered in response to requirements of the zone.

According to the invention, induction unit 10 has a first induction section 19 provided with a first induction means to induce a flow of secondary air into induction unit 10 for entrainment with the primary air stream. In the preferred embodiment, the first induction means comprise a converging venturi section 25 having a throat 26 and an inlet opening 27 displaced from nozzle opening 21. The cross-sectional area at throat 26 of venturi section 25 is preferably larger than the cross-sectional area of nozzle opening 21.

The relatively high velocity flow of primary air through venturi section 25 entrains air from space A within unit 10 in a manner well-known in the art to produce a flow of mixed primary air and secondary air through throat section or duct 28. One of side walls 11 is provided with a secondary air inlet 29 through which secondary air is induced thereby providing a flow of secondary air into unit 10 for entrainment with the primary air flow. Thus, provided the primary air velocity is sufficiently high, a continuous flow of secondary air is induced through inlet 29.

In analyzing the induction action which takes place at venturi section 25 using momentum equations, it is observed that the theoretical maximum ratio of the total air flow volume, $Q_t$, to the primary air flow volume $Q_p$, equals the ratio of the cross-sectional area $A_t$ at throat 26 to the cross-sectional area $A_p$ of nozzle opening 21. Therefore, the theoretical maximum total air flow volume is given by the following equation: $Q_t = Q_p(A_t/A_p)$. Since the sum of the primary air flow volume and the secondary air flow volume equals the total air flow volume, it is thus seen that there is a corresponding theoretical limit on the amount of secondary air which can be induced.

In a typical building air distribution system, there are limitations on the space available for the air distribution equipment such as air induction units of the type described in the instant application. These space limitations necessarily impose size constraints on the air induction units. Thus, while it may be theoretically possible to increase the total amount of induced air flow by providing a larger venturi with a larger cross-sectional area at the throat, the size of the venturi is limited since the aforementioned size constraints reduce the space available within the unit. In addition, while total air flow volume can be increased to a certain extent by designing the induction means to provide a higher $A_t/A_p$ ratio. However, it has been found in practice that efficiency losses develop if this ratio is too large. Thus, there are also practical limits on the respective sizes of $A_p$ and $A_t$. From the foregoing it is apparent that for a given primary air flow there is a limit to the amount of secondary air which can be induced by known air induction units having a single induction means.

It has been found that the amount of induced secondary air can be increased in spite of the aforementioned theoretical limitation by providing an additional secondary air induction means downstream from the first induction means capable of taking advantage of the high energy content of the mixed air stream which may be present following an initial induction of secondary air. Assuming the air velocity of the mixed air stream produced by the first induction means is sufficiently high, the second induction means will permit the entrainment of additional secondary air into the mixed air stream so as to increase the total volume of induced secondary air.

According to the invention induction unit 10 is provided with a second induction section 30 and means for delivering a stream of mixed air from first induction section 19 to second induction section 30, which means may be independent of or part of either induction section. In the preferred embodiment, second induction section 30 has a second induction means comprising an expansion unit such as diverging venturi section 31 associated with the throat outlet 32 of duct or throat section 28 which serves as the means for delivering the mixed air stream to second induction section 30. As shown, diverging venturi section 31 terminates at outlet 15. The additional secondary air induction means comprises a passage 33, shown as an opening in a wall 34 of venturi section 31, which allows secondary air to be induced into the mixed air stream from area B within induction unit 10. Passage 33 may be located in any convenient position so long as it is downstream from the first point of induction. An additional secondary air inlet 35 is provided in a wall 11 of box 10 to permit a flow of secondary air into induction unit 10 and through passage 33 for entrainment with the mixed air stream flowing into venturi section 31. It should be noted that if the portion of walls 11 associated with induction section 30 are removed, inlet 35 may comprise passage 33.

First induction section 19 and second induction section 30 are preferably separated by a wall 36 to isolate the secondary air stream flowing through inlet 29 from the secondary air stream flowing through inlet 35.

It will be apparent that second induction section 30 can be constructed in different ways to accomplish the inducement of additional secondary air. For example, diverging venturi section 31 could be displaced from throat outlet 32 to provide the passage 33, or venturi section 31 could be replaced by a straight duct or by a venturi-duct combination having a converging venturi section displaced from outlet 32 in a manner similar to the relationship between nozzle opening 21 and venturi section 25. However, the diverging venturi section 31 is employed in the preferred embodiment in order to reduce pressure losses on discharge so as to obtain a more satisfactory air flow pattern as air is discharged through outlet 15. This construction also permits gradual, uniform expansion of the mixed air stream thereby reducing development of negative pressure areas with consequent reduction in sound levels. Uniform expansion within venturi section 31 also results in a reduction in the velocity of the air flow delivered at outlet 15 thereby substantially reducing undesirable draft conditions within the zone while still delivering the volume of air required for adequate circulation within the zone.

Since the air velocity decreases as it flows through diverging venturi section 31, it is preferable to locate passage 33 proximate to outlet throat 32 so that secondary air can be induced at the point of highest air velocity within venturi section 31.

Figure 3:
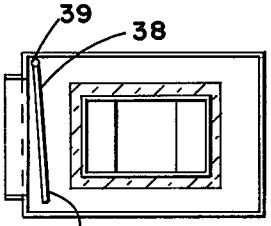
FIG. 3 is a sectional view of a portion of the air induction unit of FIG. 1, taken along the line 3—3 in FIG. 1 additionally showing a backflow damper associated with one of the secondary air inlets.

The preferred embodiment has another feature which is included to address back pressure problems which may be encountered in the system. It is well known that in air distribution systems back pressure may develop from downstream system flow resistance. Under certain circumstances this back pressure may be sufficient to inhibit induction of secondary air by the secondary induction means as described above. Further, in some cases it has been found that this back pressure results in part of the mixed air stream flowing through throat section 28 being diverted so that part of this air flows out through passage 33 and a secondary air inlet 35. This condition is commonly referred to as a backflow condition. In such situations, it is obvious that there is no secondary air induction taking place at passage 33 and the flow of a portion of the mixed air stream out through inlet 35 results in undesirable non-uniformity of the flow pattern of air discharged into the zone. In order to insure that substantially all of the mixed air is delivered through outlet 15 even when high back pressure conditions exist, a means, such as backflow damper 37, is provided to inhibit air flow out of inlet 35. As best seen in FIGS. 2 and 3, damper 37 is sufficiently large to cover secondary air inlet 35 and is mounted at its top edge 38 in any convenient manner for rotation about pivot 39. When arranged in this manner, damper 37 is biased by its own weight toward the closed position and will thus move to the closed position in the absence of a flow of secondary air into induction unit 10 through inlet 35. Thus, as soon as the back pressure reaches a level which prevents induction of secondary air damper 37 will close and no portion of the mixed air stream will be permitted to flow out through inlet 35. Since no mechanism is provided for positive operation of damper 37, the damper is preferably relatively light in weight so that the damper will readily open in response to flow of induced air. While numerous devices could be employed, damper 37, as mounted, provides a simple, inexpensive means to inhibit backflow through inlet 35.

By providing additional air induction means downstream from a first point of secondary air induction, the instant invention provides an induction unit having greatly enhanced induction capabilities when compared with existing units. It will be readily apparent to those skilled in the art that numerous modifications and alternate constructions are possible without departing from the scope and spirit of the invention. Therefore, the invention is not limited to the preferred embodiment described herein but rather is limited solely by the claims.

We claim:

1. An air induction unit comprising: a primary air inlet for receiving a supply of primary air from a supply duct; an outlet for delivering air toward a point of use; a first induction section associated with said primary air inlet, a second induction section, and an air duct connecting said first induction section to said second induction section; said first induction section comprising a first secondary air inlet for delivering secondary air into said unit and a first induction means responsive to the flow of primary air to induce a flow of secondary air into said unit through said first secondary air inlet to form a stream of mixed primary and secondary air for delivery to said second induction section through said connecting duct; said second induction section comprising an expansion unit having a throat connected to said connecting duct and diverging walls downstream from said throat, a second secondary air inlet for delivering secondary air into said unit, and a second induction means effective proximate said throat and responsive to the flow of said mixed air stream to induce a flow of additional secondary air into said unit through said secondary air inlet for mixture with said mixed air stream; and a wall between said first induction section and said second induction section so as to prevent communication within said unit between the respective induced secondary air flows.

2. An air induction unit comprising: a primary air inlet for receiving a supply of primary air from a supply duct; an outlet for delivering air toward a point of use; a first induction section associated with said primary air inlet, a second induction section, and an air duct connecting said first induction section to said second induction section; said first induction section comprising a first secondary air inlet for delivering secondary air into said unit and a first induction means responsive to the flow of primary air to induce a flow of secondary air into said unit through said first secondary air inlet to form a stream of mixed primary and secondary air for delivery to said second induction section through said connecting duct; said second induction section comprising an expansion unit having a throat connected to said connecting duct and diverging walls downstream from said throat, a second secondary air inlet for delivering secondary air into said unit, a damper in operative relationship with said second secondary air inlet to automatically close said inlet so as to prevent air flow out of said unit through said second secondary air inlet in the absence of a flow of secondary air therethrough into said air induction unit, and a second induction means effective proximate said throat and responsive to the flow of said mixed air stream to induce a flow of additional secondary air into said unit through said secondary air inlet for mixture with said mixed air stream.

3. An air induction unit according to claim 2 wherein said damper is biased by gravity to close said secondary air inlet in absence of a flow of secondary air therethrough into said air induction unit.

4. An air induction unit according to either claim 1 or 2 wherein said second induction means comprises an opening in a wall of said expansion unit proximate said throat for delivery of secondary air into said expansion unit.

* * * * *